United States Patent [19]

Portnoy

[11] 4,127,195

[45] Nov. 28, 1978

[54] CLOTHES DRYER RACK

[76] Inventor: Simon Portnoy, 300 Edward St., Roslyn Heights, N.Y. 11577

[21] Appl. No.: 769,294

[22] Filed: Feb. 16, 1977

[51] Int. Cl.[2] ..... A47F 5/08

[52] U.S. Cl. ..... 211/100

[58] Field of Search ..... 211/101, 100, 171, 204; 248/225.1

[56] References Cited

U.S. PATENT DOCUMENTS

| | | | |
|---|---|---|---|
| 115,250 | 5/1871 | Snyder | 211/171 |
| 360,386 | 3/1887 | Hiscock | 211/100 |
| 2,011,193 | 8/1935 | Duket | 248/225.1 X |
| 2,117,627 | 5/1938 | Principessa | 211/171 |
| 2,510,287 | 6/1950 | Lane et al. | 211/171 X |
| 2,812,150 | 11/1957 | Winterhoff | 248/225.1 |

FOREIGN PATENT DOCUMENTS

| | | | |
|---|---|---|---|
| 533,747 | 5/1955 | Belgium | 211/100 |
| 277,960 | 9/1951 | Switzerland | 211/100 |
| 624,904 | 6/1949 | United Kingdom | 211/100 |
| 612,872 | 11/1948 | United Kingdom | 211/101 |

*Primary Examiner*—Roy D. Frazier
*Assistant Examiner*—Robert W. Gibson, Jr.
*Attorney, Agent, or Firm*—Bacon & Thomas

[57] ABSTRACT

A semi-circular body which may be removably mounted on a supporting surface has radial sockets slidably receiving clothes rods. The rods have longitudinally spaced enlargements in the sockets, larger than bottom slots opening from the sockets through the bottom of the body. The rods may be pulled forwardly to remove the front enlargements from the sockets and a narrow portion of each rod, between the enlargements, can swing downwardly through the slot to an inoperative position. Abutments in the sockets prevent complete removal of the rods.

5 Claims, 7 Drawing Figures

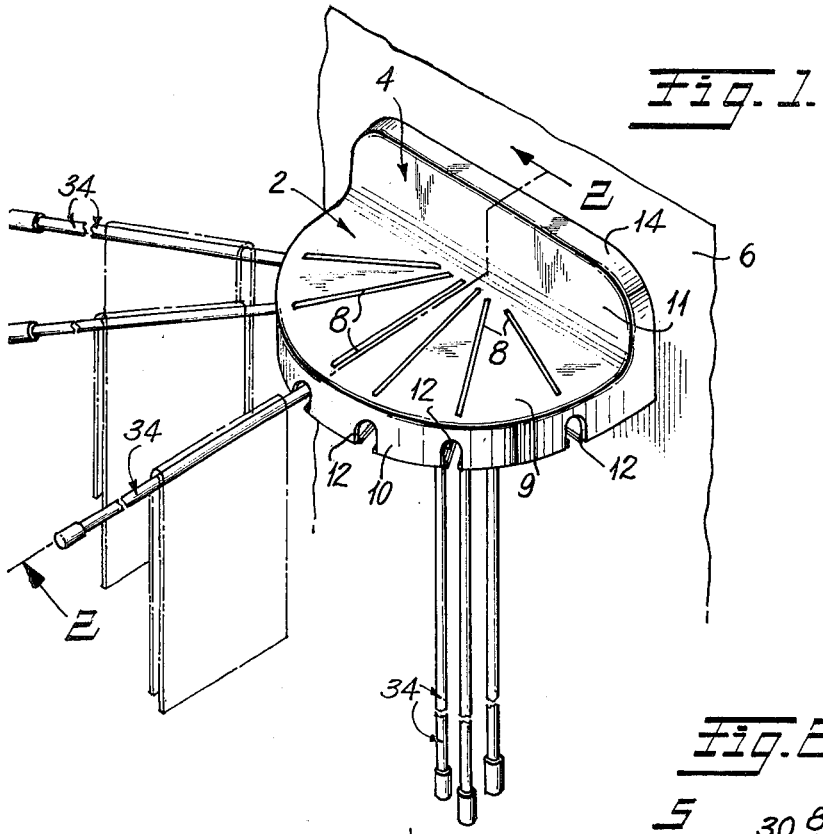
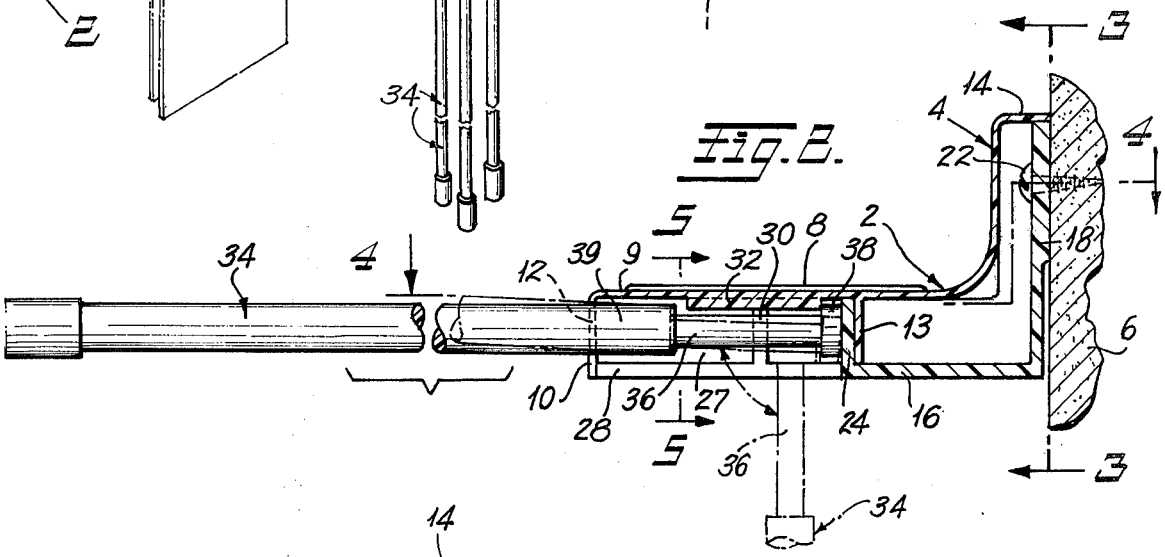
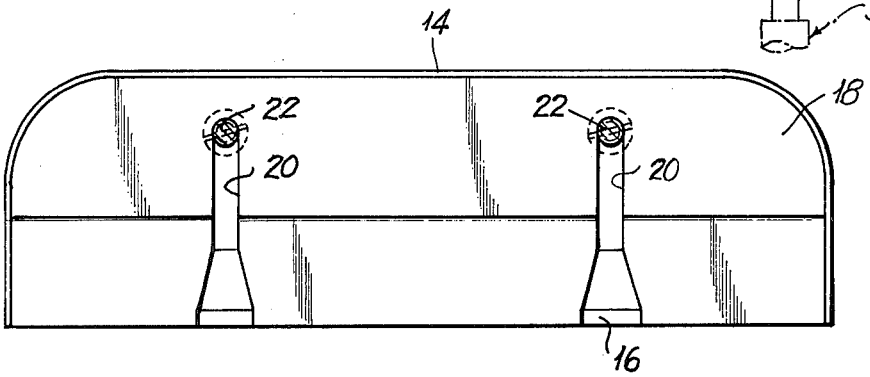
Fig. 3.

CLOTHES DRYER RACK

BACKGROUND OF THE INVENTION

This invention is in the field of clothes drying racks or the like.

Many collapsible clothes drying or towel racks have been proposed heretofore but most suffered disadvantages in that they were unattractive or required fairly complicated manipulations to erect the rods for use or move them to inoperative positions. Some such prior devices required sliding the entire length of each supporting rod through an opening in a support to move it from operative to inoperative position or vice versa. Examples of such prior devices are U.S. Pat. Nos. 528,498, 115,250 and 3,522,889. Other proposals have involved the use of dryer rods that in one position extend horizontally to support clothes or the like and in the inoperative position depend downwardly from a support but spaced a considerable distance outwardly from a supporting wall or the like and thus protrude on the usable space in the immediate vicinity. Examples of such are U.S. Pat. Nos. 528,498, 775,184, 1,046,318 and 2,117,627. Other devices involved merely pivoting the clothes supporting rods to a support for movement from a horizontal operative position to a vertical inoperative position, such devices are exemplified by U.S. Pat. No. 2,664,210.

SUMMARY OF THE INVENTION

The present invention involves a collapsible clothes dryer rack wherein the rods may be moved from operative to inoperative position with minimum movement or manipulation thereof and wherein the rods in their inoperative position are closely adjacent a supporting surface. The invention further contemplates a structural arrangement capable of being molded from plastic materials to define an attractive assembly suitable for use within a home.

BRIEF DESCRIPTION OF THE DRAWINGS

FIG. 1 is a perspective view of the rack of the present invention showing some of the article support rods in their operative position and some in their inoperative position;

FIG. 2 is an enlarged fragmentary vertical sectional view, taken on the line 2—2 of FIG. 1;

FIG. 3 is a rear elevational view, partly in section taken on the line 3—3 of FIG. 2;

DESCRIPTION OF THE PREFERRED EMBODIMENTS

Figure 4:
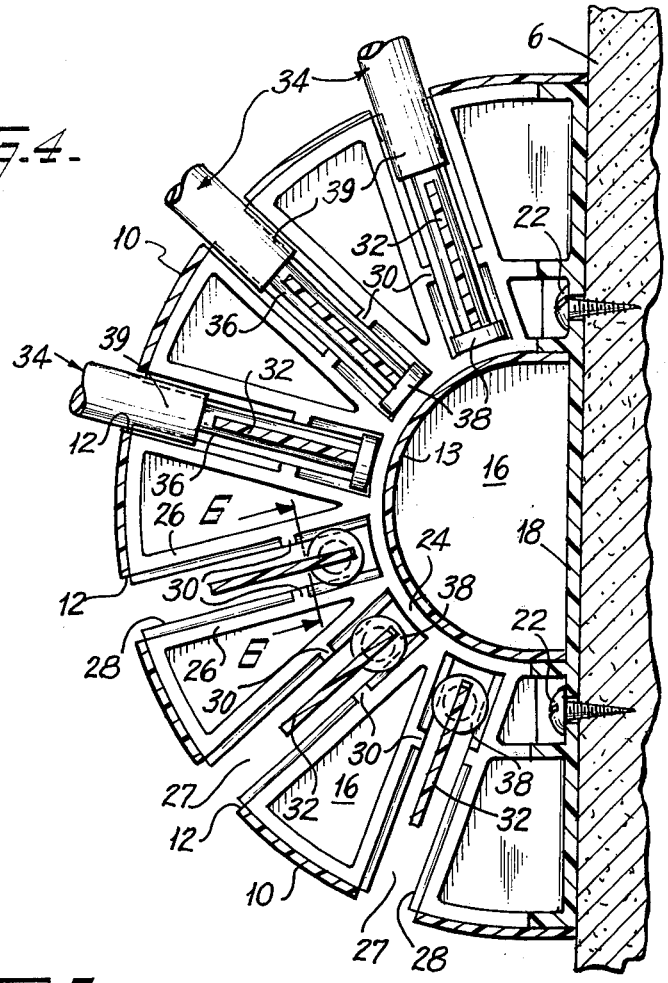
FIG. 4 is a fragmentary horizontal sectional view, taken on the staggered line 4—4 of FIG. 2.
Figure 5:
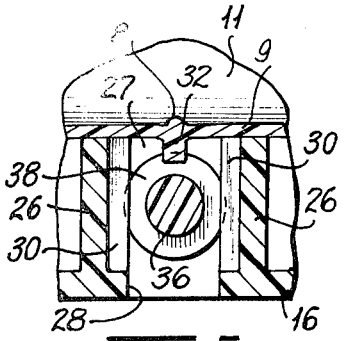
FIG. 5 is an enlarged fragmentary sectional view, taken on the line 5—5 of FIG. 2.
Figure 6:
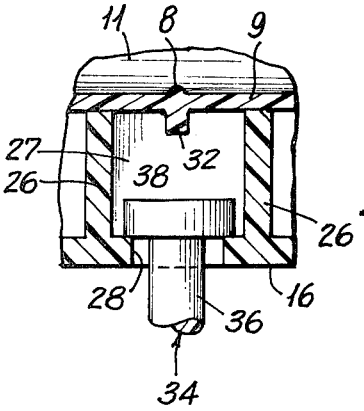
FIG. 6 is a fragmentary sectional view, similar to FIG. 5, but showing a support rod in the inoperative position.

As shown in the drawings, FIG. 1, the device comprises a generally semi-circular body portion 2 and an upstanding rear portion or hollow flange 4 adapted to be mounted on a supporting wall 6 or the like. Preferably, the front of the portion 4 and the top of portion 2 are imperforate to present a neat appearance and the portion 2, which extends horizontally, may be provided with ribs 8 thereon to provide a non-slip surface upon which articles may be stored. As shown in the drawings, the body member comprising portions 2 and 4 is formed of separate moldings. The upper wall 9 on which ribs 8 are formed is a relatively thin sheet-like member (see FIG. 2) provided at its outer periphery with a downwardly extending semi-circular flange 10 provided with downwardly open notches 12 therein. A semi-circular flange 13 is also formed integral with the upper wall 9 thus described and the sheet-like wall 11 defines the forward surface of the hollow back 4 and is provided with a peripheral flange 14 forming an integral extension of the peripheral flange 10. A lower sheet-like member defining the bottom surface of the device is shown at 16 and is formed with an upstanding rear flange 18 fitting within the flange 14 to define the hollow flange-like portion 4. The flange wall 18 is formed with a pair of slots 20 therein (FIG. 3) extending downwardly through the lower edge of the flange 18 and terminating at their upper ends below the flange 14. Preferably, the slots 20 are flared downwardly and outwardly at their lower ends whereby they may readily receive the heads of suitable supporting screws 22 mounted on the supporting wall 6. Thus, the device may be secured to the supporting wall and readily removed therefrom without any securing means being visible.

The bottom wall 16 is formed with a semi-circular upwardly extending flange 24 in position to abut the outer surface of the previously described flange 13 formed on the upper wall portion 9. Thus, the flanges 13 and 24 serve to properly correlate the parts when assembled so that the forward edge of lower wall 6 abuts the lower inner surface portion of the semi-circular flange 10. The upper and lower parts of the body may be cemented or otherwise secured together in the described relationship. As best seen in FIG. 4, the lower wall 16 is formed with upstanding generally radial flanges 26 arranged in pairs on opposite sides of each of the notches 12 in flange 10 and thus define inwardly extending radial sockets 27. The bottom wall 16 is further provided with a radial groove 28 between each pair of flanges 26. The width of the slots 28, however, is less than the distance between parallel flanges 26. In other words, the slots 28 are narrower than the sockets 27 defined by flanges 26. The flanges 26 extend rearwardly and are integrally joined to the upstanding flange 24 previously referred to and which defines an inner end wall or bottom for each socket 27. Intermediate the inner and outer ends of the sockets, the flanges 26 are formed with inwardly directed ribs 30 extending inwardly of the sockets for a purpose to be described later.

The upper wall 9 of the device has formed thereon longitudinally extending ribs 32 extending downwardly a short distance along the center line of each of the sockets 27 previously described and it is to be noted that the rear or inner ends of the ribs 32 terminate at a position spaced forwardly of the flange 24.

Extending through each notch 12 in flange 10 and into the sockets 27 between flanges 26 are clothes supporting rods 34. As shown in FIG. 2, each rod 34 has a reduced diameter portion 36 in each of the sockets resulting in a rearward enlargement 38 and a full-diameter portion 39 extending into the socket. The diameters of the rods 34 and the enlargements 38 are greater than the width of the slots 28 but small enough to be freely slidable in the sockets beneath the ribs 32. The diameter of the portion 36 is less than the width of the slots 28.

When any rod 34 is in the position illustrated in full lines in FIG. 2, it will be apparent that its forward end will tend to drop downwardly by gravity but the portion 39 of the rod extending into the socket cannot drop downwardly through the slot 28, as is the case with enlargement 38. However, the portion 39 of the rod in the front end of the socket provides a fulcrum over the slot 28 to lift the enlargement 38 upwardly to the top of the socket. In this position, the enlargement 38 extends into the space between the end of rib 32 and the flange 24 and the rod is thus temporarily locked against forward sliding movement in the socket. Obviously, the weight of any article of clothing on the rod 34 will add to the moment acting to hole the enlargement 38 upwardly in the described locked position. The distance from the lower surface of rib 32 to the bottom of the socket is slightly greater than the diameter of the enlargement 38 so that the outer end of the rod may, when desired, be lifted to depress the enlargement 38 downwardly to the bottom of the socket at which time it can be slid forwardly under the rib 32 until it engages the ribs 30 which then arrest its forward movement. However, when the rod has slid forwardly far enough to engage enlargement 38 with ribs 30, the forward end of the reduced portion 36 is forwardly of the notches 12 and portion 39 is completely out of the socket 27 and in this position the rod may be swung downwardly about the enlargement 38 as a pivot. The reduced portion 36 will thus pass freely through the slot 28 and the rod may assume the depending position shown in dotted line in FIG. 2 until such time as it is desired to again use the device. From the dotted line position, the rod may be swung forwardly and upwardly until it is aligned with the socket at which time it may be slid rearwardly to the position shown in solid line in FIG. 2 whereupon it is ready for use.

As shown in FIG. 2, the major portion of the rod 34 is of relatively large diameter, preferably the same diameter as the enlargement 38 and the reduced portion 36 may be produced by molding or turning a portion of the original rod to smaller diameter.

Figure 7:
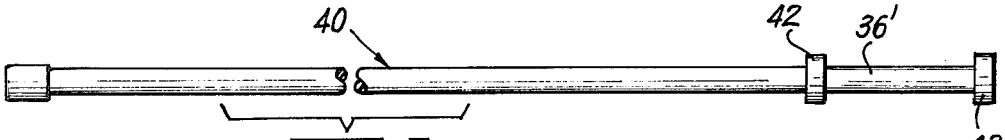
FIG. 7 is an elevational view of a modified form of an article support rod.

FIG. 7 illustrates an alternative form of rod wherein the rod 40 is of the same diameter as the reduced portion 36' and enlarged collars 42 are molded or otherwise secured on the rod 40 to serve the same functions as the enlargement 38 previously described and the portion 39 of the rod 34 that extends a short distance inwardly of the socket. Clearly, the rod 40 would be of a diameter less than of the width of the slot 28 and the diameter of the collars 42 would be greater than the width of slot 28.

While a single specific embodiment of the invention has been shown and described herein, the same is merely illustrative of the principles involved and other alternative features may be employed within the scope of the appended claims. For example, the body portion 2 could be rectangular in shape with a straight front edge and with the sockets 27 parallel to each other.

I claim:

1. A dryer rack comprising:

a generally planar body member having means for mounting the same on a support to extend generally horizontally therefrom and having spaced upper and lower surfaces and a front edge; first abutment means in said socket intermediate the ends thereof positioned therein to engage said rear enlarged portion when said rod is slid outwardly of its socket by an amount to remove said front enlarged portion from said sockets to prevent further forward movement of said rod;

a plurality of horizontal sockets opening through said front edge and extending into said body between said upper and lower surfaces and being defined and bounded by said flanges;

a longitudinal slot, of less width than said sockets, extending from the bottom of each of said sockets, throughout the length thereof, through said lower surface and through said front edge;

a rod slidably positioned in each socket and extending forwardly therefrom each rod having longitudinally spaced front and rear enlarged portions in its socket, said front enlarged portion extending outwardly of said socket and said rear enlarged portion bearing against a top wall of said socket to thereby hold said rod in a horizontal position, said enlarged portions being of greater width than said slot and separated by a rod portion sufficiently narrow to pass freely through said slot; said body member comprising a relatively thin walled upper portion defining said upper surface with an integral flange depending therefrom to define said front edge, a plate-like bottom portion defining said lower surface, being secured to the lower edge portion of said flange, and having integral upstanding flanges defining the lateral sides of said sockets.

2. A dryer rack as defined in claim 1 including a second abutment in each socket, extending downwardly therein from the top of said socket in position to engage the front of said rear enlarged portion when said enlarged portions are in said socket, the bottom of said second abutment being spaced from the bottom of said socket a distance greater than the height of said rear enlarged portion.

3. A dryer rack as defined in claim 2 including means defining a rear end of each socket rearwardly of each second abutment and engageable with the rear end of each rod to limit inward movement thereof.

4. A dryer rack as defined in claim 1 wherein said body member is generally semi-circular with said front edge defined by a semi-cylindrical surface, each of said sockets extending radially of said semi-cylindrical surface.

5. A dryer rack as defined in claim 1 wherein said means for mounting said body comprises a hollow upstanding flange-like portion at the rear of said body and having spaced front and rear walls, there being at least a pair of upwardly extending slots in said rear wall from the bottom edge thereof to a point below the top of said flange-like portion.

* * * * *